US005526222A

United States Patent [19]

Fender

[11] Patent Number: 5,526,222

[45] Date of Patent: Jun. 11, 1996

[54] BACKGROUND RECHARGING SCOROTRON

[75] Inventor: William D. Fender, Pasadena, Calif.

[73] Assignee: Xerox Corporation, Stamford, Conn.

[21] Appl. No.: 353,607

[22] Filed: Dec. 12, 1994

[51] Int. Cl.[6] ..... H01T 23/00

[52] U.S. Cl. ..... 361/230; 361/225; 355/221

[58] Field of Search ..... 361/212, 220, 361/221, 225, 230, 235; 355/221, 225

[56] References Cited

U.S. PATENT DOCUMENTS

| | | | |
|---|---|---|---|
| 4,837,658 | 6/1989 | Reale | 361/230 |
| 5,025,155 | 6/1991 | Hattori | 250/326 |
| 5,365,317 | 11/1994 | Folkins et al. | 355/255 |

*Primary Examiner*—Fritz M. Fleming
*Attorney, Agent, or Firm*—Robert Cunha

[57] ABSTRACT

In a xerographic image, where a darker area is separated by a lighter area across a sharp boundary, there is an edge enhancement effect where there will be a black outline around the darker area and a white outline around the lighter area. In x-ray mammography, the effect is that the skin line will be darkened for a positive image and lightened for a negative image, and a loss of detail at the skin line will result. To increase visible detail at the skin line without increasing the radiation, a recharging scorotron can be used between the imaging and toner stations to recharge back to a low level of charge only those areas of the latent image that have been fully discharged. All other areas are allowed to remain unchanged. The result is a reduction of skin line deletions at a reduced x-ray exposure. Such a scorotron, in the shape of a box around the corona wires, can be constructed using a conductive top, insulative sides and a screen bottom. The top is held at approximately 200 volts, and the screen, made of fine wire, closely spaced, is held at about 40 volts. The distance from screen to photoreceptor is about 0.06 inches.

2 Claims, 3 Drawing Sheets

BACKGROUND RECHARGING SCOROTRON

BACKGROUND OF THE INVENTION

Apparatus for enhancing the detail at the boundary of light and dark areas of a xerographically produced image wherein, after exposure but before development, the photoreceptor is partially recharged using a scorotron having a biased screen between the scorotron corona wires and the photoreceptor which charges photoreceptor areas that are discharged to below some predetermined level up to that level, but to not charge those areas that are already above the predetermined level.

In the xerographic process, the surface of a photoreceptor is charged up to a relatively high level, 1600 volts, for example, at a charging station. Next, the photoreceptor is partially discharged by illuminating it with a light image. The areas that receive light become conductive and conduct the surface charges to ground, while the areas not receiving light remain unaffected and the surface charge remains. Next, at the development station, the surface is brought into contact with toner which is charged to be attracted to the charged (or discharged) areas. Finally, at the transfer station, the toner is transferred to a sheet of paper to make a hard copy.

A characteristic of this process is a boundary effect where the colors on both sides of a sharp boundary are enhanced. For example, at a sharp boundary between dark gray and light gray areas, the dark gray area will be outlined in black at the boundary, and the light gray area will be outlined in white at the boundary.

In some cases, this boundary effect will decrease the usefulness of the resultant image. For example, in x-ray mammography, at the minimum x-ray level that will generate good detail, the tissue appears as a darker gray area against a lighter background, with a sharp boundary at the skin line. Details, such as small tumors and calsifications, that will show up in the bulk of the image will be obscured at the skin line by this darkening effect. This is referred to as "skin line deletion ", and can be described by using a numerical example. Assume that, in a fairly uniform area, a visible line can be seen when there is a difference of 2 volts. That is, a boundary will be visible when there is a change from 50 to 52 volts, the 52 volt side will appear darker than the 50 volt side. However, if the 50 to 52 volt boundary is placed just within the skin line, and the background has a potential of 10 volts, then both the 50 and 52 volt areas will appear black, and the detail will be lost. In general, skin line deletion is caused by potential differences greater than about 25 volts between the edge of the breast and the background outside the breast area. To reduce the skin line boundary, the current approach is to increase the radiation by about 50%, which discharges the entire image to lower levels, thereby reducing the difference between the average tissue and background discharge levels, and allowing more detail to be visible.

To lighten up the image so that details are visible at the skin line, more image radiation is used, but since x-rays themselves are a cancer causing agent, this greater radiation dose is undesirable. What is required, and provided by this invention, is a method for enhancing the image quality at the boundary without increasing the radiation.

SUMMARY OF THE INVENTION

The process for reducing the boundary effect produced at a minimum level of radiation is to charge up to a predetermined voltage only the discharged portions of the photoreceptor after exposure but prior to development, without affecting the charged portions. This can be described by using a numerical example. Assume that a photoreceptor is charged to 1600 volts, and then is partially discharged at an imaging station. At this point, the areas which received no radiation will still be at the full potential, the fully discharged areas will be discharged down to approximately 10 volts, and those areas that are partially discharged may have a charge of 50 volts, more or less. After development, the positive image will have white areas where the photoreceptor was fully discharged, black areas where the photoreceptor was still fully charged, and lighter or darker areas of gray where the photoreceptor retained intermediate voltages containing image information. An analogous process is used for negative images.

In this case, variations in the amount of radiation reaching the photoreceptor will result in variations in the darkness of the output image. However, at the boundary, small variations of gray will be obscured by the overall darkness of the print. To improve the quality of the image at the boundary (without increasing the radiation), this invention requires that, after the imaging step, the areas of the photoreceptor that are charged at less than some predetermined voltage, assume 40 volts, after imaging be recharged back up to 40 volts, but that all other areas of the photoreceptor be left unchanged. Now, the boundary effect is reduced because there is only ten volts of potential difference between the gray level of the tissue and the white level of the background. Therefore, details at the skin line will become visible in the boundary area, without the need to increase the radiation.

Since prior scorotrons charge the entire area of a photoreceptor, a selective scorotron must be used for this purpose. To continue to use the numerical example, a scorotron that will charge only those areas that are below 40 volts, and to charge them up to only 40 volts, is required. Such a scorotron has a set of corona wires held at a high potential to generate the ions, an upper conductive plate held at about 250 volts and non conductive sides walls to drive the ions downward, and a screen between the wires and the photoreceptor which is held at 40 volts. In this case, positive ions will go through the screen to any part of the photoreceptor that is at a potential of less that 40 volts, but will collect on the screen if the adjacent photoreceptor surface is at a higher potential. Compared to present radiation levels, through the use of this invention, exposure savings of a factor or two or more are possible without loss of information at the skin line.

DETAILED DESCRIPTION OF THE INVENTION

Figure 1:
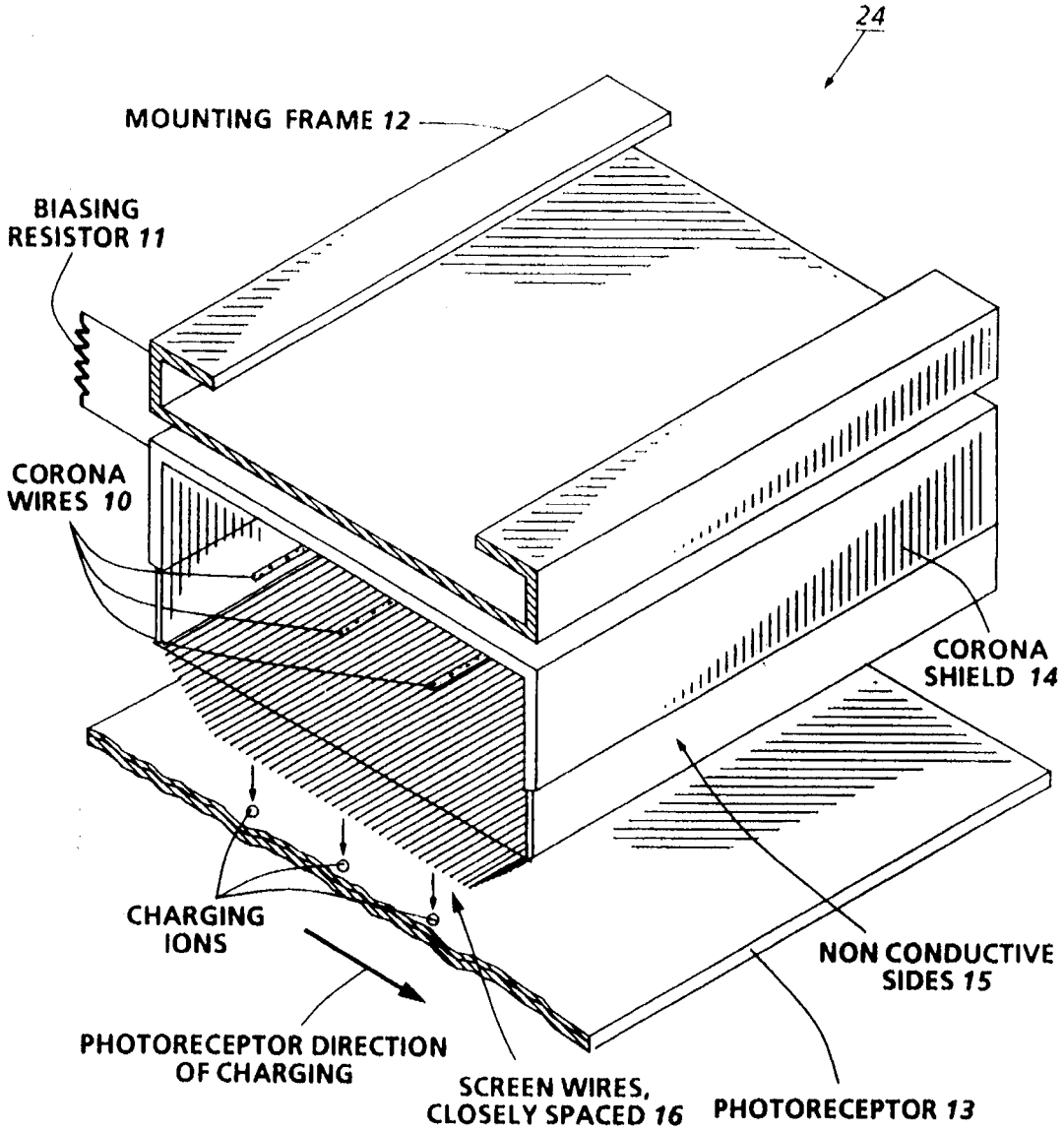
FIG. 1 is a cross-sectional isometric view of the recharge scorotron.

The background scorotron of FIG. 1 has three corona wires 10 having a diameter of approximately 3.5 mils (0.089 millimeter) held at a voltage of 6.5 KV to generate the positively charged ions.

A 220 Megohm resistor 11 is used to partially isolate the corona shield 14 from the grounded mounting frame or support structure 12. This arrangement results in an approximate shield 14 voltage of from 200 to 400 volts, and prevents many of the ions from being attracted to the shield. In previous scorotrons, the shield is typically grounded (zero resistance), which results in the necessity of a higher corona voltage and a loss of a significant percentage of the ions to ground. Greater resistance results in excessive shield potentials which tend to suppress the ion generation rate at the corona wires.

All sides of this scorotron are closed with non conductive material 15 so that the ions emitted from the corona can escape only through the screen 16. This complete enclosing of the corona wires avoids corona spill-over which must be eliminated to achieve the desired sharp charging potential cutoff point essential to avoiding destruction of image detail just inside and adjacent to the recharge boundary.

The screen 16 is positioned at a distance of about 0.060 inches (1.5 millimeters) from the photoreceptor 13, with a range of 20 to 200 mils (0.5 to 5 millimeters), and is made from sixty finely spaced screen wires of from 2 to 5 mils (thousandths of an inch) in diameter (0.05 to 0.13 millimeters) INCONEL. The space between screen wires is from 10 to 30 thousandths of an inch (0.25 to 0.75 millimeters). The fine screen wire spacing of this described embodiment minimizes intrusion of electrostatic field irregularities through the screen surface, created by the high corona wire potential. The minimal diameter of the screen wire reduces ion robbing by the many screen wires, leaving more ions free to traverse the screen plane and charge the photoreceptor.

Figure 2:
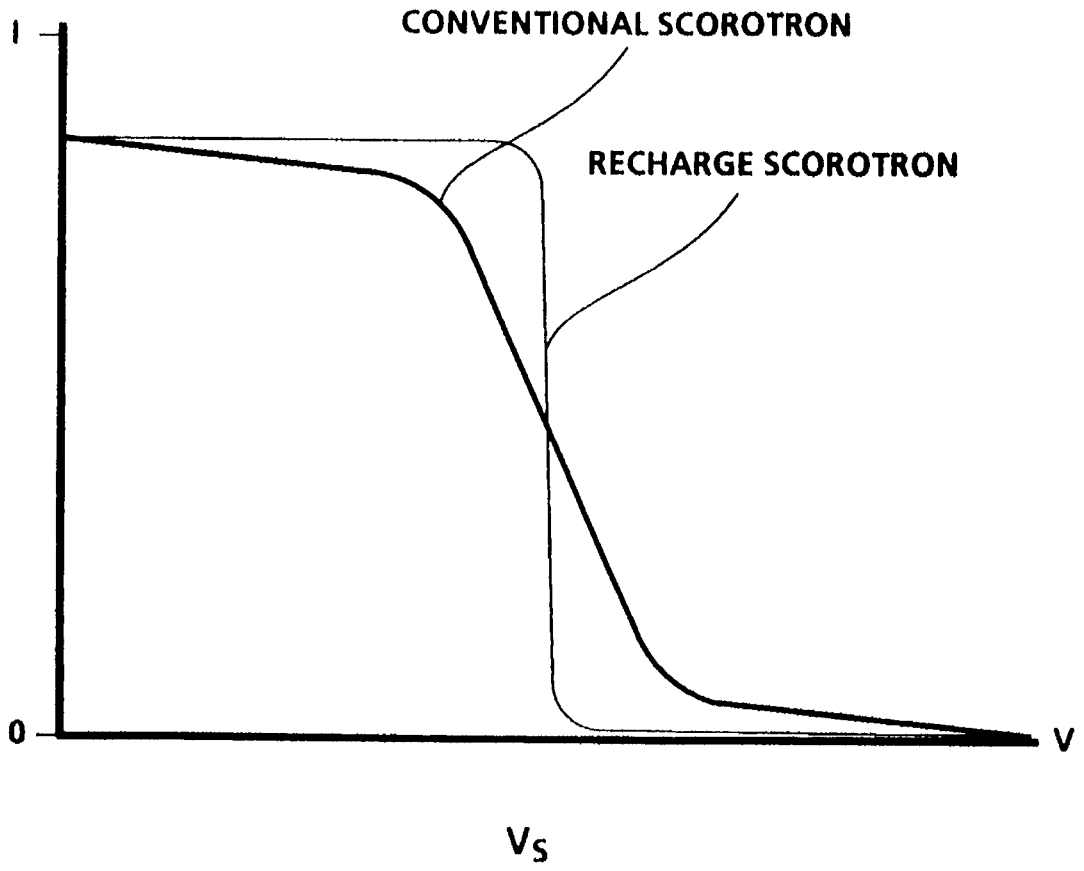
FIG. 2 is a graph showing the recharge scorotron response curve.

The reduced spacing between the photoreceptor and screen intensifies the field created in this region, allowing more precise control of the charging ions, sharpening the response curve. FIG. 2 illustrates the sharp potential cutoff achieved with the proposed recharge scorotron in comparison to those usually used. FIG. 2 is a plot of ion-current-density applied to the photoreceptor as a function of photoreceptor surface potential. The response curve of the standard scorotron lacks sharpness in that charging current "I" continues to be applied even after the photoreceptor surface potential reaches the preset constant screen potential "Vs". The preferred embodiment described herein, however, has a much sharper response, indicating that much less charge is applied once the photoreceptor surface potential has achieved the desired preset scorotron screen potential. It is this sharp response property which prevents erosion of the image charge pattern at potentials just above Vs and allows the invention to function effectively as described.

The use of this invention allows an image to be made using significantly less radiation. For example, for images exposed at 50 KVP, a typical image would be made at 150 mAs and would show an acceptable level of skin line deletion of about 0.060" (1.5 millimeters) width. If the exposure is reduced to 90 mAs (milli-ampere seconds), a 40% reduction, image detail is sharper, but is obscured by the dark area at the boundary because of the resultant unacceptably wide deletion width of approximately 0.125" (3.1 millimeters). Finally, using the recharge scorotron described herein, and a reduced exposure of 90 mAs, the deletion width is acceptable and comparable to that made at 150 mAs without the recharge scorotron.

Figure 3:
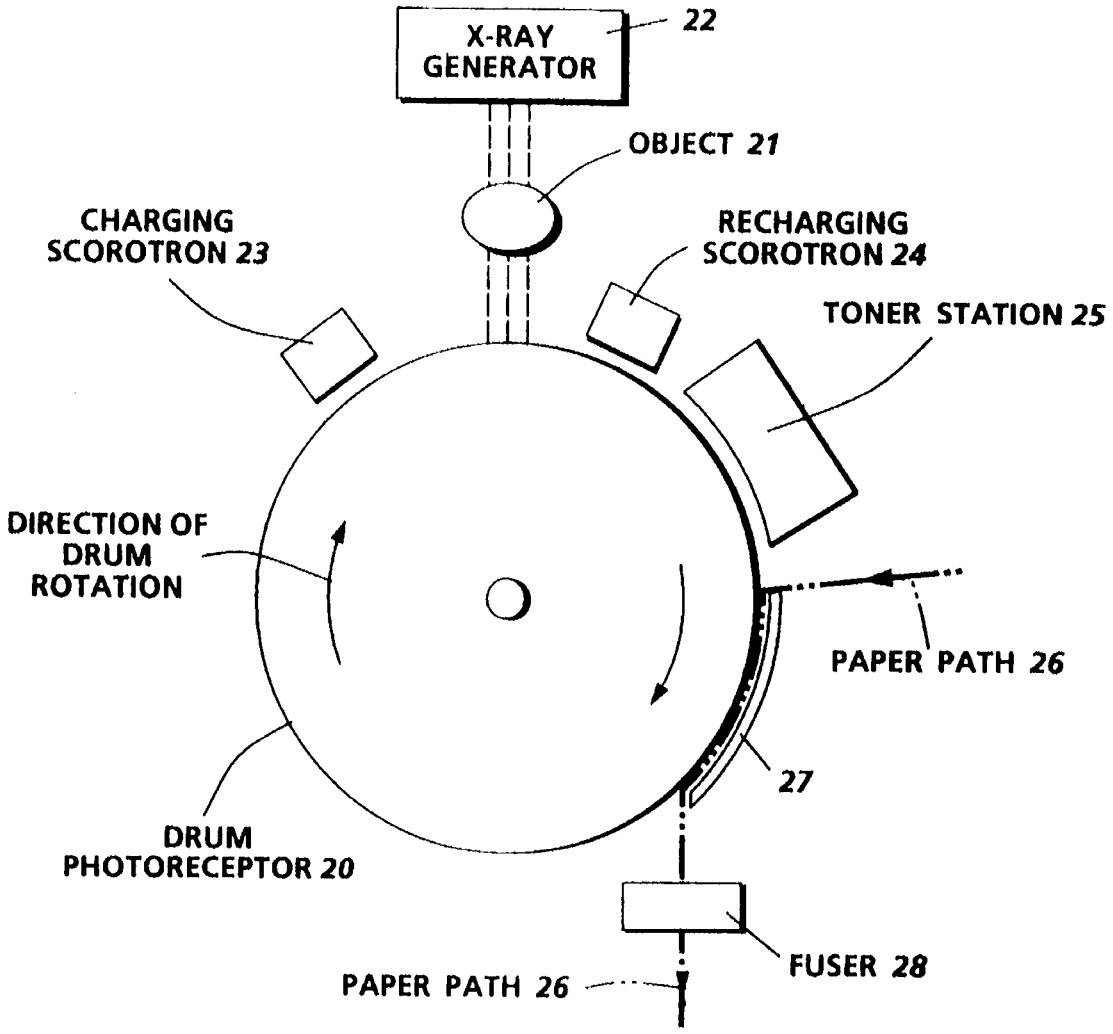
FIG. 3 is an overall view of the xerographic system using this invention.

The recharging scorotron is used in a xerographic system as shown in FIG. 3. Assuming that the rotation of the photoreceptor drum 20 is clockwise as shown, first the charging scorotron 23 charges the surface of the photoreceptor to a high voltage. After the charged portion of the drum has been rotated to the next station, an x-ray generator 22 will generate x-rays which are used to penetrate an object 21 and fall on the charged drum surface, which partially discharges the surface charge to form a latent image. The drum continues to rotate, exposing the latent image to the recharging scorotron 24 which recharges the completely discharged areas to a predetermined voltage which may be between 15 and 150 volts. Next, as the paper traverses the paper path 26, toner is applied to the latent image at the toner station 25, and the toner is transferred from the drum 20 to the paper 27. Finally the toner is fused to the paper at the fusing station 28 to form the permanent hard copy.

While the invention has been described with reference to a specific embodiment, it will be understood by those skilled in the art that various changes may be made and equivalents may be substituted for elements thereof without departing from the true spirit and scope of the invention. In addition, many modifications may be made without departing from the essential teachings of the invention.

What is claimed is:

1. A scorotron, for use in a xerographic system which has a photoreceptor which moves in a plane relative to the position of said scorotron, comprising:

a lower screen in a plane parallel to said photoreceptor's plane of movement, and separated by a distance of between 20 and 200 mils, said screen comprising a number of parallel wires, said wires being between 2 and 5 mils in diameter and spaced apart by a distance of between 10 and 30 mils, said screen wires being held at a voltage of between 15 and 150 volts, side walls made of a non-conductive material and extending up from said screen, a conductive surface held at a voltage of between 200 and 400 volts connecting said side walls to form an enclosed three-dimensional space having a lower screen, insulating side walls and a conductive top, and corona wires within said enclosed space to generate ions.

2. The scorotron of claim 1 wherein said voltage of said conductive surface is generated by a resistor connecting said surface to ground.

* * * * *